US006128987A

United States Patent [19]

Nakagawa et al.

[11] Patent Number: 6,128,987

[45] Date of Patent: Oct. 10, 2000

[54] HYDRAULIC PRESS FOR FORMING METAL PLATES

[75] Inventors: Tatsuji Nakagawa, Kanagawa; Itaru Fujimura; Hiroshi Hosoya, both of Tokyo; Junkichi Comikawa, Kanagawa; Kazuhiko Fujimoto, Yamanashi, all of Japan

[73] Assignee: Aida Engineering Co., Ltd., Japan

[21] Appl. No.: 09/026,329

[22] Filed: Feb. 19, 1998

[30] Foreign Application Priority Data

Mar. 26, 1997 [JP] Japan ..... 9-091686

[51] Int. Cl.[7] ..... B26D 5/20; B21D 31/02; B30B 1/42

[52] U.S. Cl. ..... 83/76.9; 83/214; 72/325; 72/338; 100/269.14; 100/273

[58] Field of Search ..... 83/39, 76.6, 76.9, 83/213, 214; 72/325, 338, 404; 100/48, 94, 98 R, 231, 269.14, 273

[56] References Cited

U.S. PATENT DOCUMENTS

| | | | |
|---|---|---|---|
| 3,738,569 | 6/1973 | Killaly, Sr. | 83/76.7 |
| 4,486,841 | 12/1984 | Koyama | 72/21 |
| 4,509,355 | 4/1985 | Oishi | 72/325 |
| 4,611,483 | 9/1986 | Hadaway | 72/453.02 |
| 4,630,442 | 12/1986 | Massaro et al. . | |
| 4,633,745 | 1/1987 | Asano | 83/214 |
| 4,833,971 | 5/1989 | Kubik . | |
| 4,977,804 | 12/1990 | Naito | 83/76.7 |

FOREIGN PATENT DOCUMENTS

| | | |
|---|---|---|
| 0311779 | 4/1989 | European Pat. Off. . |
| 4036564 | 5/1992 | Germany . |
| 8-257795 | 8/1996 | Japan . |
| 09702132 | 1/1997 | WIPO . |

*Primary Examiner*—M. Rachuba
*Attorney, Agent, or Firm*—Morrison Law Firm

[57] ABSTRACT

A hydraulic press has closed loop feedback control on a slide, a slide pad and bolster cylinders. Hydraulic cylinders actuating various components of the press are controlled according to ideal position estimates to produce consistent and precise pressing action. A closed loop control consists of an ideal position/pressure value generator, a position/pressure detector and an arithmetic unit comparing the ideal and actual position/pressure values. Using the ideal and actual comparison result, the arithmetic unit produces a control signal to drive a cylinder to a desired position/pressure. The hydraulic press is capable of performing several operations on a workpiece in one press cycle, an improvement over presses requiring several operation steps or die changes. The bolster cylinders augment clamping force, reduce shock, and improve die alignment to produce better results with less wear on press components.

43 Claims, 9 Drawing Sheets

HYDRAULIC PRESS FOR FORMING METAL PLATES

BACKGROUND OF THE INVENTION

The present invention relates to a hydraulic press for forming metal plates.

Japanese laid-open patent publication number 63-49410 discloses a similar machine for performing compression forming of plastic. In that device, a plurality of pressure cylinders (hydraulic cylinders) are used to raise and lower a movable plate. Since a single piston is used to both raise and lower the movable plate, a large amount of pressurized oil is required.

Japanese laid-open patent publication number 01-266999 and Japanese laid-open patent publication number 02-84308 disclose conventional technologies for controlling the degree of horizontal uniformity of the movable plate. In these technologies, a bed or a bolster is equipped with a hydraulic cylinder to serve as a countering mechanism. The degree of horizontal uniformity is maintained by having the bed or bolster press against the lower surface of the movable plate when it is close to the bottom dead center point. However, these types of hydraulic cylinders that act as countering mechanisms can be an obstruction when replacing dies and the like, and there is also a shock when the lower surface of the movable plate comes into contact with the countering hydraulic cylinder.

Referring to FIGS. 9(*a*)–9(*e*), there is shown the steps involved in the conventional technology for pressing an outer panel that serves as a section of the vehicle body of an automobile. This invention relates to a new apparatus geared at performing those steps in a better way.

The steps for transforming blank B into an outer panel are:

a. A blanking operation results in blank B by cutting or shearing a coiled material.

b. Blank B is drawn using upper and lower dies.

c. Upper and lower dies are used to trim the outer perimeter and a piercing punch is used to form an opening in a section of the workpiece.

d. Upper and lower dies are used to form a flange on the outer perimeter.

e. A cam die is used to apply pressure in the direction shown by the arrows and to form a flange.

Steps 9(*a*)–9(*e*) are conventionally performed in separate operations requiring moving the workpiece from one machine to another.

OBJECTS AND SUMMARY OF THE INVENTION

It is an object of the present invention is to provide a device that can use a relatively small amount of pressurized oil to raise and lower a slide on a press at relatively high speeds.

It is another object of the present invention is to provide a device that can control the degree of horizontal uniformity of a slide of a press without using a hydraulic cylinder or the like as a counter-mechanism.

It is yet another object of the present invention is to provide a device that can use a small number of processing steps in order to form a product that conventionally requires many processing steps.

Briefly stated, the present invention provides a hydraulic press has closed loop feedback control on a slide, a slide pad and bolster cylinders. Hydraulic cylinders actuating various components of the press are controlled according to ideal position estimates to produce consistent and precise pressing action. A closed loop control consists of an ideal position/pressure value generator, a position/pressure detector and an arithmetic unit comparing the ideal and actual position/pressure values. Using the ideal and actual comparison result, the arithmetic unit produces a control signal to drive a cylinder to a desired position/pressure. The hydraulic press is capable of performing several operations on a workpiece in one press cycle, an improvement over presses requiring several operation steps or die changes. The bolster cylinders augment clamping force, reduce shock, and improve die alignment to produce better results with less wear on press components.

In one embodiment of the invention, a hydraulic press for pressing an object has a crown a bed, and a column connecting the crown to the bed. A plurality of main cylinder devices are in the crown. Each main cylinder device has a fast cylinder and a pressure cylinder. The pressure cylinder is capable of exerting greater pressure than the fast cylinder. A cylinder actuating means is used for actuating the main cylinder devices. A slide is mechanically coupled to the main cylinder devices. Pressing means is disposed in the slide and the bed.

In another embodiment of the invention a hydraulic press for pressing an object has a crown, a bed, and column connecting the crown to the bed. A plurality of main cylinder devices are disposed in the crown. A cylinder actuating means is used for actuating the main cylinder devices. A slide is mechanically coupled to the main cylinder devices. A slide cylinder is disposed on the slide. A slide cylinder actuating means is used for actuating the slide cylinder. An upper punching element and an upper trimming element are mechanically coupled to the slide cylinder. A lower trimming element and a lower punching element are disposed upon the bed. The upper punching element and the lower punching element engage one another when the pressing means actuates thereby deforming the object. The upper trimming element and the lower trimming element engage one another when the pressing means actuates thereby trimming the object. A die is mechanically coupled to the slide cylinder. An object holder for holding the object, is disposed on the bed.

In yet another embodiment of the present invention, a hydraulic press for pressing an object has a crown, a bed, and a column connecting the crown to the bed. A plurality of main cylinder devices are disposed in the crown. A cylinder actuating means is used for actuating the main cylinder devices. A slide is mechanically coupled to the main cylinder devices. A pressing means is disposed on the slide. A press stabilizing means is disposed in the bed.

The above, and other objects, features and advantages of the present invention will become apparent from the following description read in conjunction with the accompanying drawings, in which like reference numerals designate the same elements.

DETAILED DESCRIPTION OF THE PREFERRED EMBODIMENTS

Figure 1:
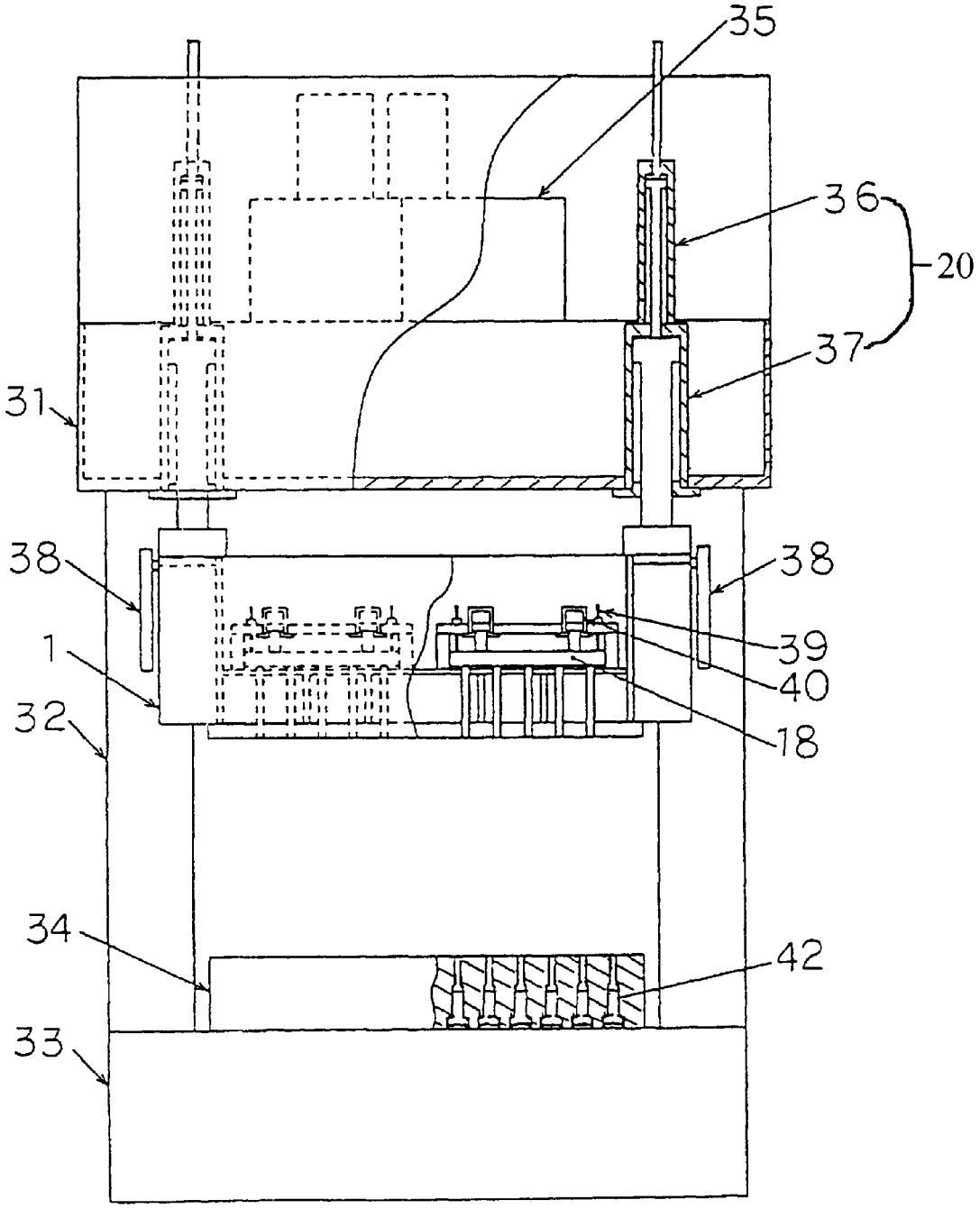
FIG. 1 is a front-view partial cross-section drawing of a hydraulic press of the present invention.
Figure 2:
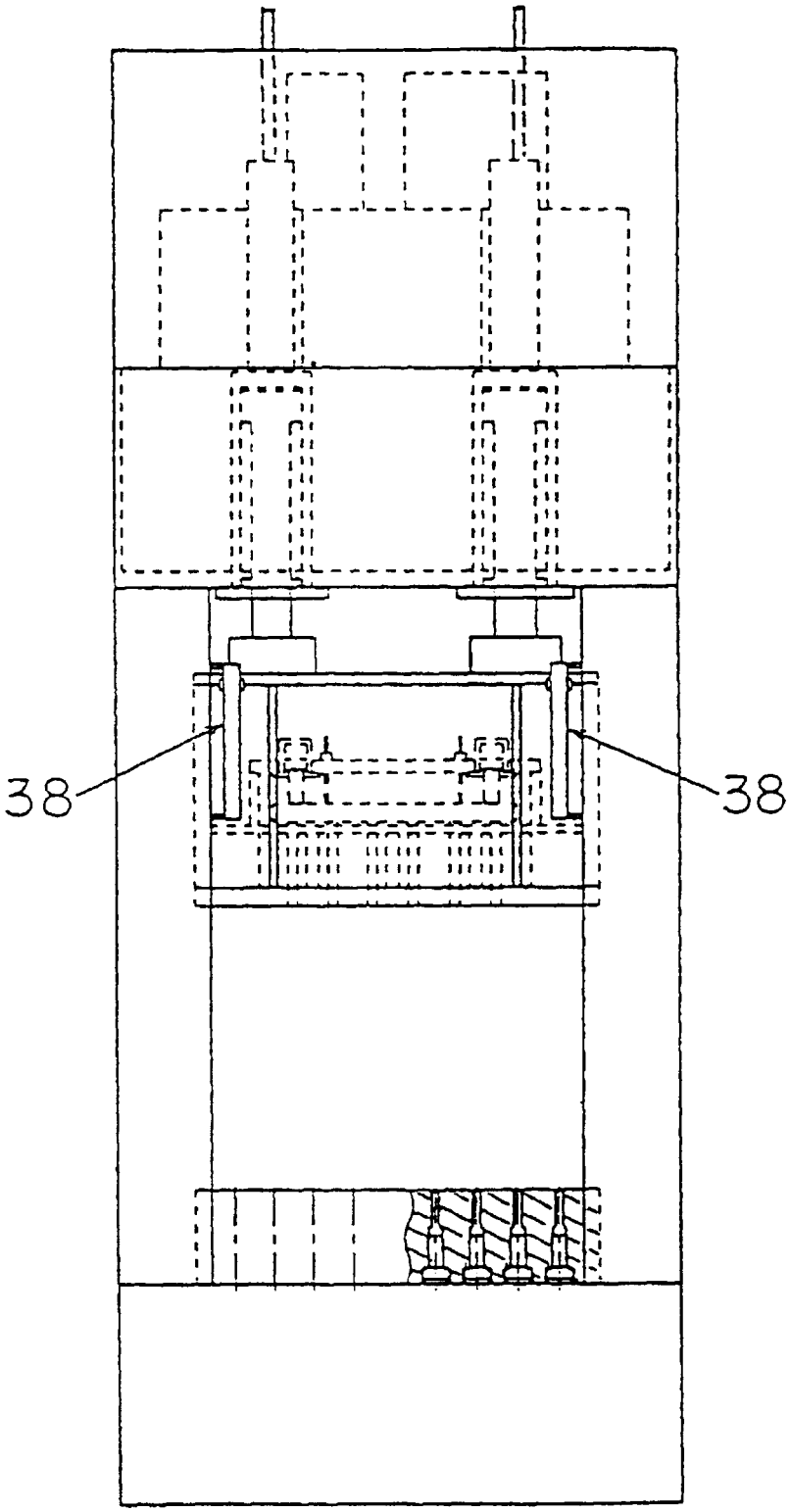
FIG. 2 is a right-side partial cross-section view of a hydraulic press of the present invention.

Referring to FIG. 1 and FIG. 2, a frame of a press includes a crown 31, a column 32, and a bed 33 formed together with a tie rod (not shown). Crown 31 is equipped with a hydraulic unit 35 and a main cylinder device 20. Main cylinder device 20 includes a fast cylinder 36 and a pressure cylinder 37.

Figure 4:
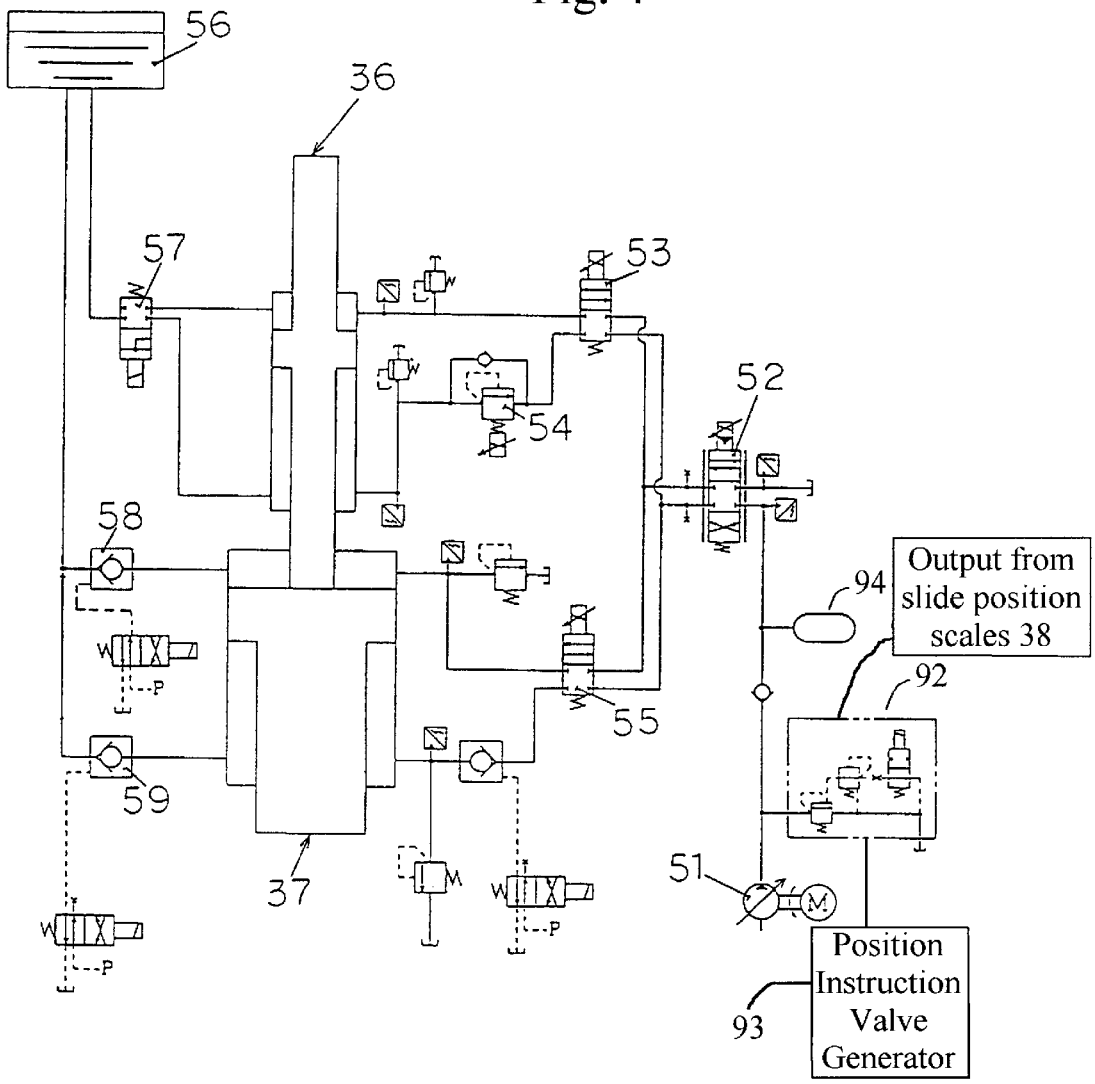
FIG. 4 is a circuit diagram for the main cylinder.

Referring also to FIG. 4, main cylinder device 20 can have either upper fast cylinder 36 and lower pressure cylinder 37 connected co-axially as shown, with fast cylinder 36 above pressure cylinder 37, or fast cylinder 36 and pressure cylinder 37 can be disposed parallel to each other. Main cylinder device 20 can also have pressure cylinder 37 disposed above fast cylinder 36 (not shown except implicitly in FIG. 1).

A slide 1 is disposed at column 32 of the frame of the press in a position so that it can move up and down. Slide 1 is also connected to main cylinder device 20 described above. In FIG. 1, upper fast cylinder 36 and lower pressure cylinder 37 are connected co-axially so that a piston rod of pressure cylinder 37 is connected to slide 1. If fast cylinder 36 and pressure cylinder 37 are disposed parallel to each other, their respective piston rods are each connected to slide 1. Thus, slide 1 is driven by main cylinder device 20 which causes it to move up and down. Slide 1 is internally equipped with a slide cylinder 40, a slide pad 18, a pad position detector 39, and other members which will be described in detail later.

A plurality of slide position detectors 38 are disposed on column 32. Slide position detectors 38 have slide position sensors (not shown) for detecting a plurality of slide positions of slide 1 with respect to column 32. This device for detecting the position of slide 1 can also be disposed on the main cylinder section described above. Thus, the position of slide 1 can be detected indirectly as well as directly.

Figure 3:
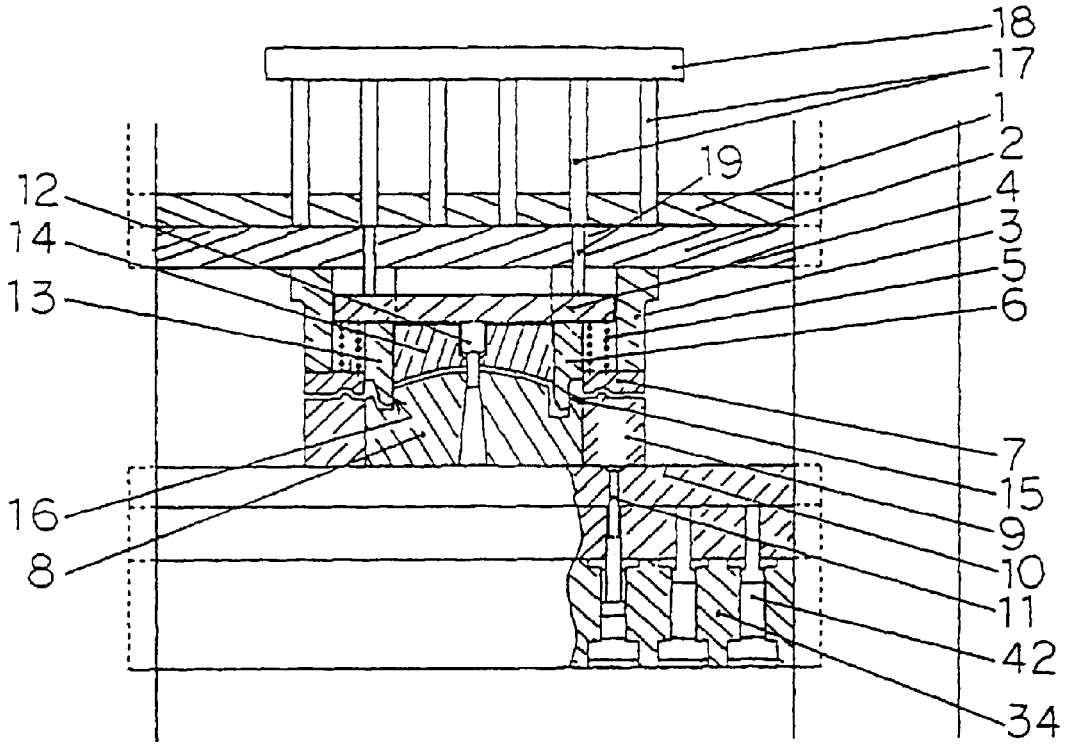
FIG. 3 is a detailed front-view of the pressing portion of the invention.

The following is a description of the press and dies. Referring to FIG. 3, both slide 1 and slide pad 18 are shown at the bottommost dead center position. An upper die set 2 and a lower die set 10 are disposed substantially parallel to each other on opposite sides of the hydraulic press. Upper die set 2 is fixed to slide 1. A die holder 3 and a die 7 are fixed to upper die set 2.

A die pad 4 is mounted inside die holder 3 and so it too can move up and down. Slide cylinder 40 (FIG. 1) presses against die pad 4 through slide pad 18 and double-action transfer pin 17. Die pad 4 is contacted by a return spring 5. A pulling-bending punch 6 and a trimming punch 13 are fixed to die pad 4 to move up and down within die holder 3 in tandem with die pad 4. A counter punch 14 penetrates through die pad 4 and is fixed to upper die set 2. A plurality of holes are formed on upper die set 2. Push pins 19 are inserted through these holes. A piercing punch 12 is fixed to die pad 4. Counter punch 14 provides adequate space to allow for the raising and lowering of piercing punch 12.

A bolster 34 is fixed below lower die set 10. Blank holder 9 is also fixed to lower die set 10 facing die 7. A bolster cylinder 42, within bolster 34, is effective to apply force against blank holder 9 via cushion pin 11.

A punch 8 is fixed to lower die set 10. A cutting section 16 and a cutting section 15 are disposed on punch 8. Cutting section 16 serves as the cutting means for trimming punch 13 and provides the final trimming operation of the formed product. The ends of pulling-bending punch 6 and trimming punch 13 are formed with cavities so that bending is performed before trimming.

Figure 9:
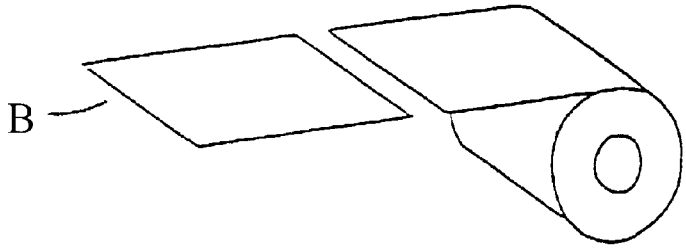
FIGS. 9(*a*)–9(*e*) show the conventional processing steps which are performed in a new way according to this invention.
Figure 9:
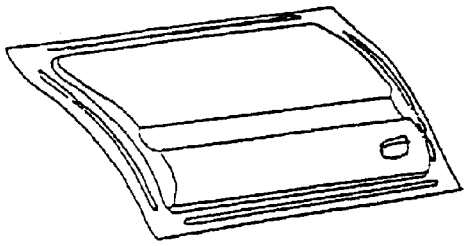
Figure 9:
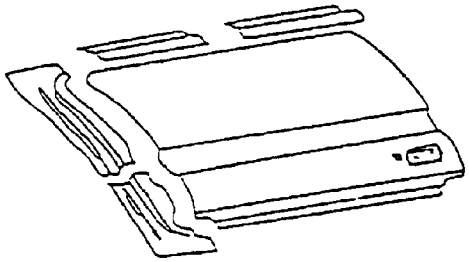
Figure 9:
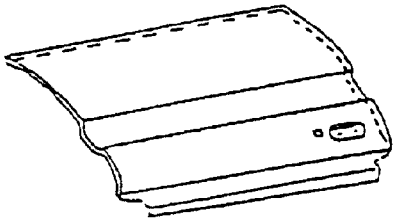
Figure 9:
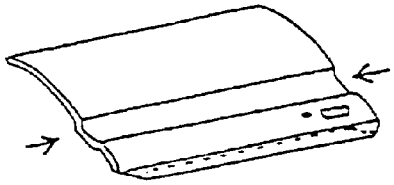

Cutting section 15 serves as the cutter means for pulling-bending punch 6 and provides a preliminary trimming operation of the formed product. Punch 8 subsequently acts as the die for pulling-bending punch 6 and performs flanging. Punch 8 and piercing punch 12 perform piercing in conjunction with one another. Punch 8 also has an outward tapering hole to let out scrap debris generated by the piercing operation. Initially, die 7 is urged downward by return spring 5. As slide 1 moves downward, the blank is first contacted by die 7 and its perimeter is forced downward against blank holder 9. The mating groove in die 7 and boss in blank holder 9 form a holding ridge in the blank as shown in FIG. 9(*b*) to firmly secure the edges of the blank for subsequent operations.

The drawing operation, i.e., the first forming operation, is performed as counter punch 14 moves downward toward punch 8. With a blank held by die 7 and blank holder 9, the second forming operation, that of trimming and piercing, is performed as trimming punch 13, pulling-bending punch 6, and piercing punch 12 are moved downward by the continued downward motion of slide 1. Since all of these elements are located near one another, these steps are performed in close temporal proximity with one another (even in one single step) unlike the prior art which executes one step at a time with significant delay and possible handling between successive steps.

FIG. 4 shows one possible oil pressure circuit for providing pressurized oil to fast cylinder 36 and pressure cylinder 37. Various tubes are connected to fast cylinder 36 and pressure cylinder 37 from a hydraulic unit 35 disposed on crown 31. Pressurized oil from a pump 51 is sent to fast cylinder 36 via a servo valve 52 and a circuit switching ratio valve 53, which serves as a circuit switching valve. Oil from an oil tank 56 is sent via a switching valve 57 to fast cylinder 36. Pressurized oil from pump 51 is also sent to pressure cylinder 37 via a servo valve 52 and a circuit-switching ratio valve 55, which also serves as a circuit switching valve. When fast cylinder 37 is active, oil from an oil tank 56 is sent via pre-fill valves 58, 59 to fast cylinder 37.

Figure 7:
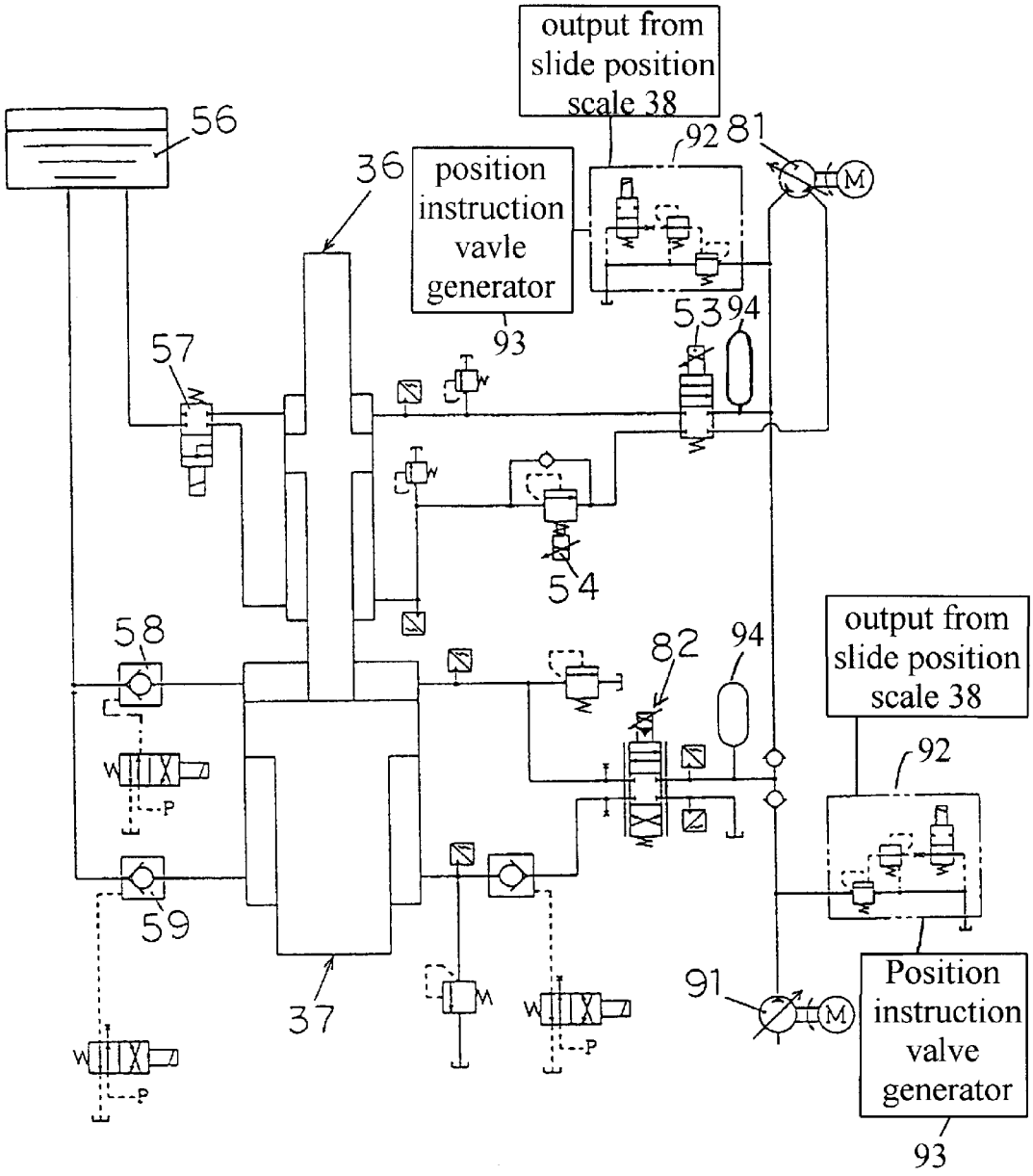
FIG. 7 is an alternative circuit diagram for the main cylinder.

Referring to FIG. 7, there is shown a schematic of a different fluid flow circuit from the one shown in FIG. 4. Pressurized oil from a servo pump 81 is sent to fast cylinder 36 via circuit switching ratio valve 53, which serves as a circuit switching valve. Pressurized oil from a charge pump 91 is sent to pressure cylinder 37 via a servo valve 82. When the pressure from the oil in the servo pump 81 increases, the pressurized oil is sent via servo valve 82 to pressure cylinder 37. Other elements of the circuit are identical to that of FIG. 4. In FIG. 4, pump 51 and servo valve 52 are used to supply pressurized oil to the main cylinder device, but it would also be possible to use servo pump 81 (of FIG. 7) instead of pump 51 and servo valve 52. In FIG. 7, servo pump 81 is used to send pressurized oil to fast cylinder 36. Charge pump 91 and servo valve 82 are used to send pressurized oil to pressure cylinder 37. However, it would also be possible to use charge pump 91 and servo valve 82 to send pressurized oil to fast cylinder 36, and to use servo pump 81 to send pressurized oil to pressure cylinder 37.

Referring back to FIG. 4, the ideal motion of slide 1 in a pressing operation can be estimated before utilization of the press. In the present invention, positions for slide 1 corresponding to the pressing operation to be performed are entered beforehand in a slide position instruction value generator 93. The position values entered into slide position instruction value generator 93 act like setpoints for ideal positions used by other components in a closed loop type control. An slide arithmetic section 92 is used to compare the ideal slide position values from slide position instruction value generator 93 with detected position values measured with slide position detectors 38. Slide position detectors 38 include devices for detecting slide positions (not shown). A servo amplifier 94 is then used to amplify the signal from arithmetic section 92. Servo valve 52 (of FIG. 4) is then activated based on the amplified signal from servo amplifier 94, thus driving fast cylinder 36 and pressure cylinder 37.

To accomplish this, a plurality of slide position detectors 38 are placed around the perimeter of slide 1 to enable measurements at a plurality of positions. Fast cylinder 36 and pressure cylinder 37 are controlled by comparing the ideal slide position value entered beforehand with a plurality of slide position detection values produced by slide position detectors 38. Thus, in addition to being able to control the position and speed of slide 1, the present invention also controls the degree of horizontal uniformity of slide 1.

After the first forming operation, that is the drawing operation performed with punch 8 and counter punch 14, the second forming operation, bending, is performed. In the present invention, these two operations can be performed virtually simultaneously. The raising and lowering of pulling-bending punch 6, trimming punch 13, and the like in the bending operation are performed according to the specific pressing operation.

Figure 5:
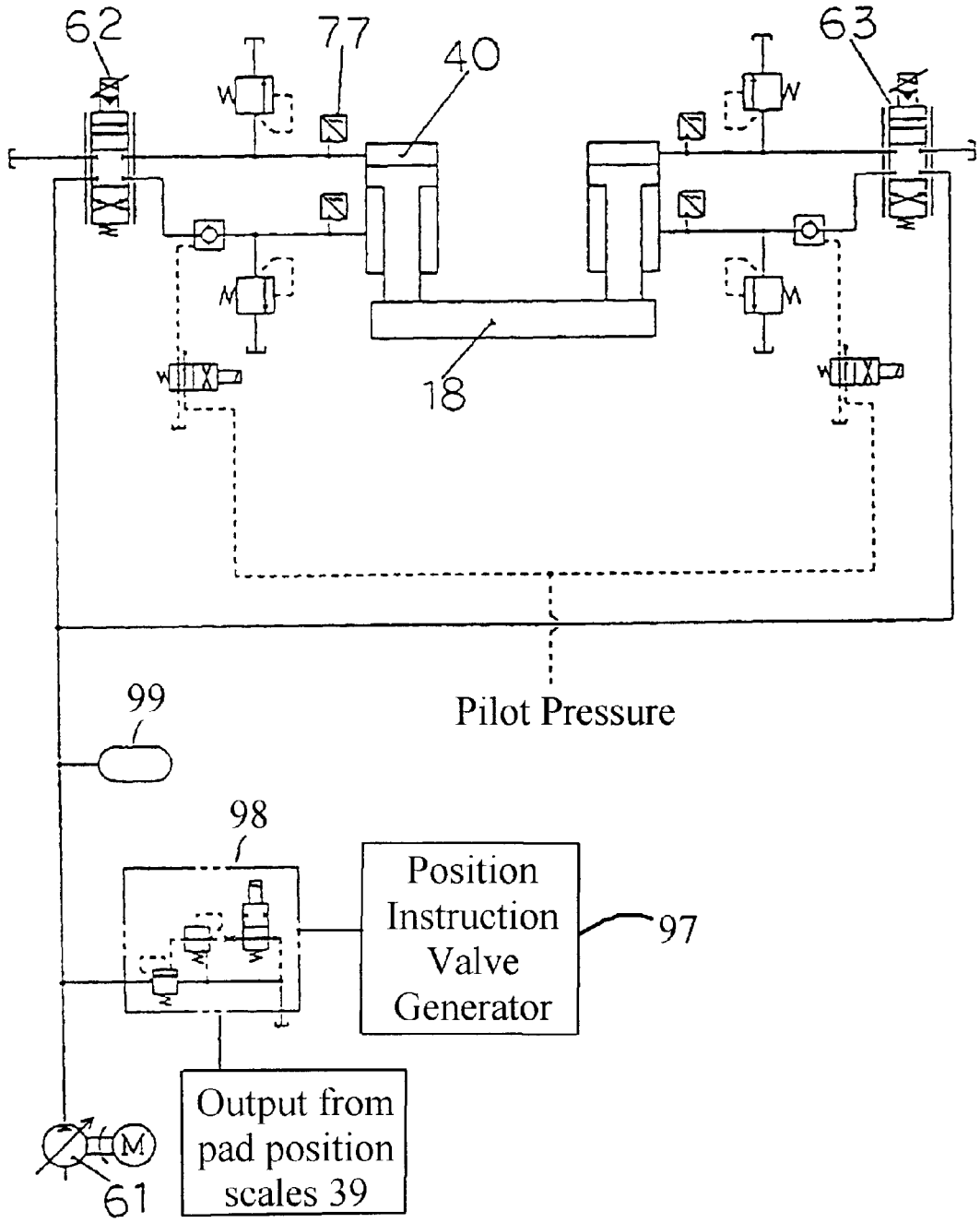
FIG. 5 is a circuit diagram for the slide cylinder.

Referring to FIG. 5, in the circuit flow diagram for the bending operation, pressurized oil from a charge pump 61 is sent to slide cylinder 40 via servo valves 62, 63. Positions for slide pad 18 corresponding to the pressing operation to be performed are entered beforehand in a slide pad position instruction value generator 97. A slide pad arithmetic section 98 compares the ideal slide pad position values from slide pad position instruction value generator 97 with the slide pad position values produced by slide pad position detectors 39. A servo amplifier 99 then amplifies the signal from slide pad arithmetic section 98. The amplified signal activates servo valve 62 and drives slide cylinder 40.

Slide pad position detectors 39 (FIG. 1) are placed at a plurality of locations on slide cylinder 40, making it possible to make measurements at a plurality of positions. Slide cylinder 40 is controlled based on the comparison of the ideal slide pad position values entered into slide pad position instruction value generator 97 and slide pad position values produced by slide pad position detectors 39. This makes it possible to control not only the position and speed of slide pad 18 but also the degree of horizontal uniformity of slide pad 18. All of those factors can be determined by placement of slide pad position detectors 39.

Figure 6:
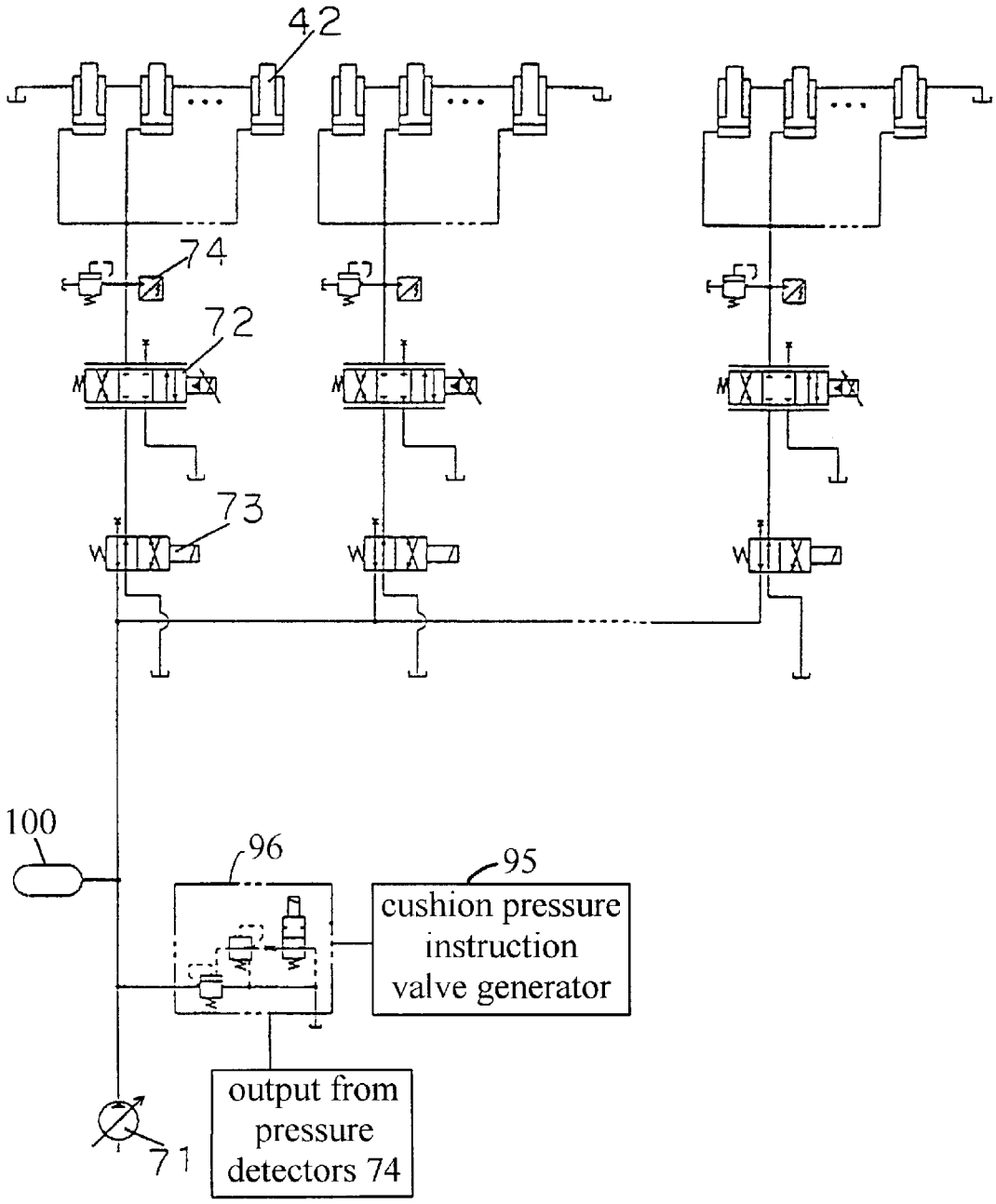
FIG. 6 is a circuit diagram for the bolster cylinder.

Referring to FIG. 6, in the circuit flow diagram for the press stabilizer, pressurized oil from a charge pump 71 is sent to bolster cylinders 42 via switching valves 73 and servo valves 72. The pressure applied by blank holder 9 is varied according to the workpiece to be pressed. In the present invention, a cushion pressure instruction value generator 95 generates ideal cushion pressure values. Pressure for the pressurized oil sent from bolster cylinder 42, i.e., the cushion pressure, is determined based on the workpiece characteristics and pressure values detected by pressure detectors 74 disposed about bolster cylinders 42. This data is entered into cushion pressure instruction value generator 95 before operation of the hydraulic press. A cushion pressure arithmetic section 96 compares detected cushion pressure values from cushion pressure detectors 74 ideal cushion pressure values values from cushion pressure instruction value generator 95. Cushion pressure arithmetic section 96 generates bolster cylinder command signals to actuate bolster cylinders 42 based on the results of the comparison of the above values.

A servo amplifier 100 amplifies the signal from cushion pressure arithmetic section 96. The amplified signal from servo amplifier 100 activates servo valves 72 and drives bolster cylinders 42. In place of a servo valve, it would also be possible to use alternative pressure control valves such as a ratio pressure control valve, a digital pressure control valve or the like.

By using a plurality of bolster cylinders 42 and hydraulic circuits connected to bolster cylinders 42, the cushion pressure can be varied locally and selectively. There is no shock when blank B comes in contact with bolster cylinders 42 and there is no obstruction created inhibiting maintenance as in the prior art.

With the present invention, a relatively small amount of pressurized oil can be used to raise and lower the slide of a press quickly. The degree of horizontal uniformity of the slide of the press can be controlled without requiring special devices, and the number of processing steps can be decreased. Furthermore, a bolster cushion device is mounted internally so that the height from the bottom surface of the machine to the bolster is less than that of conventional presses. Thus, installation of the machine does not require bits.

By using a pump and a servo valve coupled to an arithmetic unit to optimize the flow of pressurized oil to a plurality of fast cylinders and pressure cylinders, the degree of horizontal uniformity of the lower surface of the slide can be controlled. The horizontal uniformity is further controlled by the use of a pump, an arithmetic unit, and a servo valve actuating bolster cylinders in the bed of the device.

By including pressure-applying devices in the slide and the bolster, an operation that would require a plurality of steps with the conventional technology can be performed with a single step.

Figure 8:
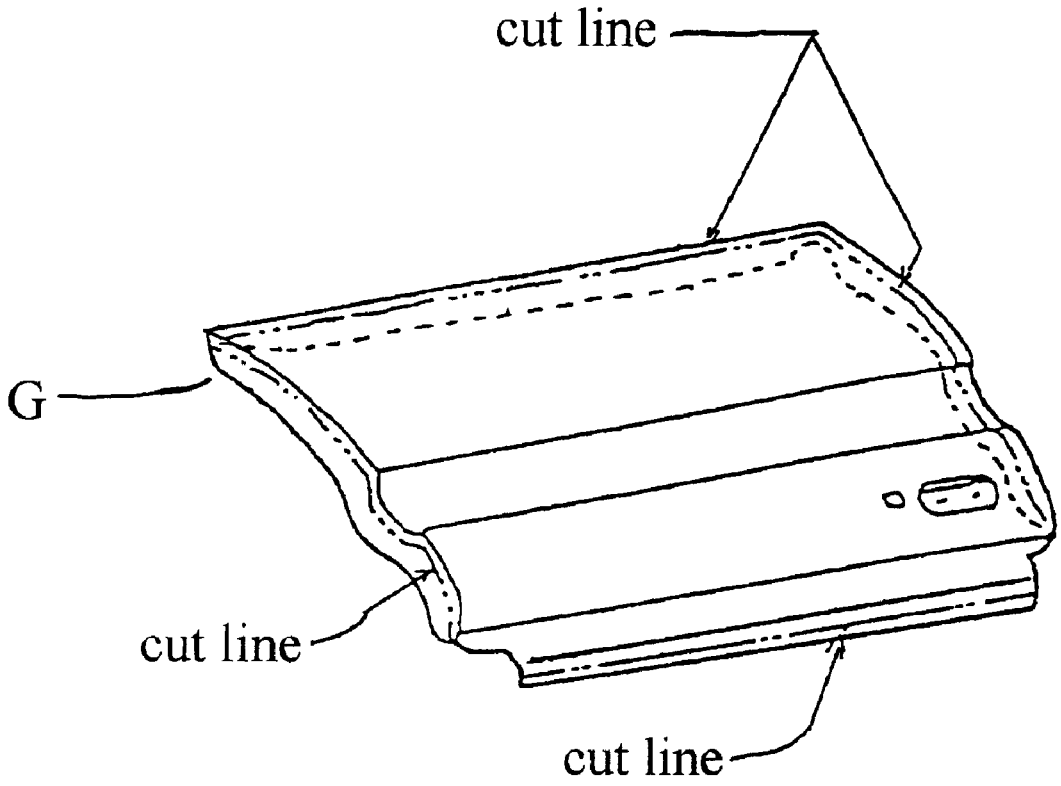
FIG. 8 is a drawing showing processing steps of the present invention.

Referring to FIGS. 9(*a*)–9(*e*), the three operations of drawing (FIG. 9(*b*)), trimming and piercing (FIG. 9(*c*)), and flanging (FIG. 9(*d*)) can be performed in one continuous operation as slide 1 moves downward. Referring to FIG. 8, the partially formed product resulting after the flange operation shown in FIG. 9(*d*) can be cut at the outer perimeter with a laser, or flanging can be performed with a cam die. This results in the formed product, an outer panel G.

In the fluid pressure circuits disclosed in the preferred embodiment, several distinct servo amplifiers, arithmetic units, and instruction value generators are used. It should be considered to be within the scope of this invention that a single amplifier, unit, or generator could be used to handle all of the tasks indicated.

In the present invention, two types of cylinders, a fast cylinder and a pressure cylinder, are disposed to raise and lower a slide of a press. When performing a pressing operation, the pressure cylinder is used. Otherwise, the fast cylinder is used. This results in a lower overall amount of pressurized fluid that is required to utilize the apparatus. In prior art devices, a pressure cylinder is used both to move the press into a pressing position and to actuate the pressing action. In the present invention, the fast cylinder moves the press to the pressing position, consuming less pressurized fluid. Only when the pressure cylinder is needed is it activated.

The above disclosure described the steps involved in creating a side door for a car. It should be considered within the scope of this invention that any other object which requires a press to be formed in a desired shape could be created by this invention. The shape of the resultant object would be dictated by a user by changing the shapes of the punch and cutting sections.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A hydraulic press for pressing an object comprising:

a bed, at least one main cylinder device having a fast cylinder and a pressure cylinder;

said pressure cylinder exerting greater force than said fast cylinder;

main cylinder actuating means for actuating said at least one main cylinder device;

a slide coupled to said at least one main cylinder device;

a punch on said bed;

a counter punch on said slide;

at least one slide cylinder disposed on said slide;

slide cylinder actuating means controlling actuation of said at least one slide cylinder;

at least one upper punching element and at least one upper trimming element coupled to said at least one slide cylinder and adjacent said counter punch;

at least one lower punching element and at least one lower trimming element on said punch;

said slide cylinder being controlled to permit said at least one upper punching element and said at least one lower punching element to cooperate to deform said object; and said slide cylinder being controlled to permit said at least one upper trimming element and said at least one lower trimming element to cooperate to trim said object.

2. A press as in claim 1 wherein:

at least one of said at least one upper punching elements is a piercing element; and at least one of said lower punching elements includes an outward tapering cavity for receiving id piercing element.

3. A press as in claim 1 wherein said slide cylinder actuating means comprises:

a charge pump;

at least one slide pad position detector disposed on said at least one slide cylinder;

a slide pad arithmetic unit coupled to said at least one slide pad position detector and at least one servo valve;

said slide pad arithmetic unit provides an output related to a result of a comparison between an ideal position value and a value from said at least one slide pad position detector;

said output controls actuation of said at least one servo valve; and said at least one servo valve actuates said at least one slide cylinder.

4. A press as in claim 1 wherein said main cylinder actuating means comprises:

a first pump;

at least one slide position detector disposed on at least one of said slide and said main cylinder devices;

a slide arithmetic unit coupled to said at least one slide position detector and a servo valve;

said slide arithmetic unit controls actuation of said servo valve based on a result of a comparison between an ideal slide position value and a value from said at least one slide position detector; and a first and second circuit switching ratio valve each coupled to a respective one of said fast cylinder and said pressure cylinder and each further coupled to said servo valve.

5. A press as in claim 4 wherein said main cylinder actuating means further comprises:

a second pump;

a switching valve coupled to said second pump and to said fast cylinder; and at least one pre-fill valve coupled to said second pump and to said pressure cylinder.

6. A press as in claim 1 wherein said main cylinder actuating means comprises:

a first and second pump;

at least one slide position detector on at least one of said slide and said at least one main cylinder device;

a first and second slide arithmetic unit each coupled to said at least one slide position detector;

at least one circuit switching ratio valve coupled to said first slide arithmetic unit and to said fast cylinder;

at least one servo valve coupled to said second slide arithmetic unit and to said pressure cylinder;

said first slide arithmetic unit controls actuation of said at least one circuit switching servo valve based on a result of a comparison between an ideal slide position value and a value from said at least one slide position detector; and said second slide arithmetic unit controls actuation of said at least one servo valve based on a result of a comparison between an ideal slide position value and a value from said at least one slide position detector.

7. A press as in claim 6 wherein said main cylinder actuating means further comprises:

a third pump;

at least one switching valve coupled to said third pump and to said fast cylinder; and at least one pre-fill valve coupled to said third pump and to said pressure cylinder.

8. A press as in claim 1 further comprising:

at least one bolster cylinder in said bed;

a pump;

at least one pressure detector disposed about said at least one bolster cylinder;

a cushion pressure arithmetic unit coupled to said at least one pressure detector and at least one switching valve;

said cushion pressure arithmetic unit controls actuation of said at least one switching valve based on a result of a comparison of an ideal cushion pressure value and a value from said at least one pressure detector; and at least one servo valve coupled to said at least one switching valve and said at least one bolster cylinder.

9. A hydraulic press for pressing an object comprising:

a bed;

a punch on said bed;

at least one main cylinder device;

main cylinder actuating means for actuating said at least one main cylinder device;

a slide coupled to said at least one main cylinder device;

a counter punch on said slide;

at least one slide cylinder disposed on said slide;

slide cylinder actuating means controlling actuation of said at least one slide cylinder;

at least one upper punching element and at least one upper trimming element coupled to said at least one slide cylinder;

at least one lower trimming element and at least one lower punching element on said punch;

said slide cylinder being controlled to permit said at least one upper punching element and said at least one lower punching element to cooperate to deform said object; and said slide cylinder being controlled to permit said at least one upper trimming element and said at least one lower trimming element to cooperate to trim said object.

10. A press as in claim 9 further comprising:

at least one of said at least one upper punching elements is a piercing element; and at least one of said lower punching elements includes an outward tapering cavity for receiving said piercing element.

11. A press as in claim 9 wherein said slide cylinder actuating means comprises:

a charge pump;

at least one slide pad position detector disposed on said at least one slide cylinder;

a slide pad arithmetic unit coupled to said at least one slide pad position detector and at least one servo valve;

said slide pad arithmetic unit provides an output related to a result of a comparison between an ideal slide pad position value and a value from said at least one slide pad position detector;

said output controls actuation of said at least one servo valve; and said at least one servo valve is coupled to said at least one slide cylinder.

12. A press as in claim 10 further comprising:

at least one bolster cylinder in said bed;

a pump;

at least one pressure detector disposed about said at least one bolster cylinder;

a cushion pressure arithmetic unit coupled to said at least one pressure detector and at least one switching valve;

said cushion pressure arithmetic unit controls actuation of said at least one switching valve based on a result of a comparison of an ideal cushion pressure value and a value from said at least one pressure detector; and at least one servo valve coupled to said at least one switching valve and said at least one bolster cylinder.

13. A press as in claim 9 wherein said at least one main cylinder device comprises:

a fast cylinder and a pressure cylinder; and said pressure cylinder exerting greater force than said fast cylinder.

14. A press as in claim 13 wherein said main cylinder actuating means comprises:

a first pump;

at least one slide position detector on at least one of said slide and said at least one main cylinder device;

a slide arithmetic unit coupled to said at least one slide position detector and a servo valve;

said slide arithmetic unit controls actuation of said servo valve based on a result of a comparison of an ideal slide position value and a value from sail at least one slide position detector; and a first and second circuit switching ratio valve each coupled to a respective one of said fast cylinder and said pressure cylinder and each further coupled to said servo valve.

15. A press as in claim 14 wherein said main cylinder actuating means further comprises:

a second pump;

a switching valve coupled to said second pump and to said fast cylinder; and at least one pre-fill valve coupled to said second pump and to said pressure cylinder.

16. A press as in claim 13 wherein said main cylinder actuating means comprises:

a first and second pump;

at least one slide position detector on at least one of said slide and said at least one main cylinder device;

a first and second slide arithmetic unit each coupled to said at least one slide position detector;

at least one servo valve coupled to said second slide arithmetic unit and to said pressure cylinder;

at least one circuit switching ratio valve coupled to said first slide arithmetic unit and to said fast cylinder;

said first slide arithmetic unit controls actuation of said at least one circuit switching servo valve based on a result of a comparison between an ideal slide position value and a value from said at least one slide position detector; and said second slide arithmetic unit controls actuation of said at least one servo valve based on a result of a comparison between an, ideal slide position value and a value from said at least one slide position detector.

17. A press as in claim 16 wherein said main cylinder actuating means further comprises:

a third pump;

at least one switching valve coupled to said third pump and to said fast cylinder; and at least one pre-fill valve coupled to said third pump and to said pressure cylinder.

18. A hydraulic press for pressing an object comprising:

a bed;

at least one main cylinder device;

main cylinder actuating means for actuating said at least one main cylinder device;

a slide coupled to said at least one main cylinder device;

pressing means disposed on said slide; and press cushioning and augmentation means disposed in said bed.

19. A press as in claim 18 where said press cushioning and augmentation means comprises:

at least one bolster cylinder in said bed;

a pump;

at least one of pressure detector disposed about said at least one bolster cylinder;

an cushion pressure arithmetic unit coupled to said at least one pressure detector and at least one switching valve;

said cushion pressure arithmetic unit controls actuation of said at least one switching valve based on a result of a comparison between an ideal cushion pressure value and a value from said at least one pressure detector; and at least one servo valve coupled to said at least one switching valve and said at least one bolster cylinder.

20. A press as in claim 18 wherein said pressing means comprises:

a punch on said bed;

a counter punch on said slide;

at least one slide cylinder disposed on said slide;

slide cylinder actuating means controlling actuation of said at least one slide cylinder;

at least one upper punching element and at least one upper trimming element coupled to said at least one slide cylinder and adjacent said counter punch;

at least one lower punching element and at least one lower trimming element on said punch;

said slide cylinder being controlled to permit said at least one upper punching element and said at least one lower punching element to cooperate to deform said object; and said slide cylinder being controlled to permit said at least one upper trimming element and said at least one lower trimming element to cooperate to trim said object.

21. A press as in claim 20 where said pressing means further comprises:

at least one of said at least one upper punching elements is a piercing element; and at least one of said lower punching elements includes an outward tapering cavity for receiving said piercing element.

22. A press as in claim 20 wherein said slide cylinder actuating means comprises:

a charge pump;

at least one slide pad position detector disposed on said at least one slide cylinder;

a slide pad arithmetic unit coupled to said at least one slide pad position detector and at least one servo valve;

said slide pad arithmetic unit provides an output based on a result of a comparison between an ideal slide pad position value and a value from said at least one slide pad position detector;

said output controls actuation of said at least one servo valve; and said at least one servo valve is coupled to said at least one slide cylinder.

23. A press as in claim 18 wherein said at least one main cylinder device comprises:

a fast cylinder and a pressure cylinder; and said pressure cylinder exerting greater force than said fast cylinder.

24. A press as in claim 23 wherein said main cylinder actuating means comprises:

a first pump;

at least one of slide position detector on at least one of said slide and said at least one main cylinder device;

a slide arithmetic unit coupled to said at least one slide position detector and at least one servo valve;

said slide arithmetic unit controls actuation of said at least one servo valve based on a result of a comparison between an ideal slide position value and a value from said at least one slide position detector; and a first and second circuit switching ratio valve each coupled to a respective one of said fast cylinder and said pressure cylinder and each further coupled to said at least one servo valve.

25. A press as in claim 24 wherein said main cylinder actuating means further comprises:

a second pump;

at least one switching valve coupled to said second pump and to said fast cylinder; and at least one pre-fill valve coupled to said second pump and to said pressure cylinder.

26. A press as in claim 23 wherein said main cylinder actuating means comprises:

a first and second pump;

at least one slide position detector on at least one of said slide and said at least one main cylinder device;

a first and second slide arithmetic unit each coupled to said at least one slide position detector;

a circuit switching ratio valve coupled to said first slide arithmetic unit and to said fast cylinder;

a servo valve coupled to said second slide arithmetic unit and to said pressure cylinder;

said first slide arithmetic unit controls actuation of said circuit switching servo valve based on a result of a comparison between an ideal slide position value and a value from said at least one slide position detector; and said second slide arithmetic unit controls actuation of said servo valve based on a result of a comparison between an ideal slide position value and a value from said at least one slide position detector.

27. A press as in claim 26 wherein said main cylinder actuating means further comprises:

a third pump;

a switching valve coupled to said third pump and to said fast cylinder; and at least one pre-fill valve coupled to said third pump and to said pressure cylinder.

28. A press comprising:

at least one fast cylinder;

at least one pressure cylinder; and a connection effective to transfer motion of said at least one fast cylinder to said at least one pressure cylinder, whereby said at least one pressure cylinder is moved rapidly into position for applying pressure.

29. A press comprising:

a first die set;

a second die set opposed to said first die set;

a first bolster cylinder effective for applying urging to said second die set at a first transverse position;

at least a second bolster cylinder effective for applying urging to said second die set at a second transverse position spaced apart from said first position;

said first and second bolster cylinders, by independent control of pressure therein, being effective to tilt said second die set with respect to said first die set;

at least first and second pressure detectors detecting first and second fluid pressures; and at least first and second control devices for controlling fluid pressure in said first and said at least second bolster cylinders and for maintaining said second die set in a predetermined alignment with said first die set.

30. A position control system for a press comprising:

at least a first and second pressing means;

at least one position detector disposed about said first and second pressing means;

said at least one position detector having means for detecting a position of said first and second pressing means and further for outputting an output; and an arithmetic unit for comparing and processing said output with desired press positions and for controlling actuation of said first and second pressing means in response to said output, whereby pressing performed by said at least first and second pressing means is performed according to said desired press positions.

31. A position control system for a press comprising:

pressing means;

at least one bolster cylinder opposing said pressing means;

at least one pressure detector disposed about said bolster cylinders;

said at least one pressure detector producing an output; and an arithmetic unit for comparing and processing said output with desired bolster cylinder pressure values and for controlling actuation of said at least one bolster cylinder, whereby said at least one bolster cylinder produces pressures according to said desired bolster cylinder pressure values.

32. A position control system for a press comprising:

at least a first and second pressing means;

at least one position detector disposed about said at least first and second pressing means;

said at least one position detector having means for detecting a position of at least one of said at least first and second pressing means and further for outputting a first output;

a first arithmetic unit for comparing and processing said first output with desired press positions and for controlling actuation of at least one of said at least first and second pressing means in response to said first output whereby pressing performed by said at least first and second pressing means is performed according to said desired press positions;

at least one bolster cylinder opposing said at least first and second pressing means;

at least one pressure detector disposed about said at least one bolster cylinder;

said at least one pressure detector producing a second output; and a second arithmetic unit for comparing and processing said second output with desired bolster cylinder pressure values and for controlling actuation of said at least one bolster cylinder to achieve said desired bolster cylinder pressure values.

33. A press according to claim 1, wherein said pressing means further includes:

an upper die coupled to said slide;

a blank holder on said bed; and said upper die and said blank holder cooperate to fix a workpiece in said press when said slide actuates.

34. A press according to claim 3, wherein said pressing means further includes:

an upper die coupled to said slide;

a blank holder on said bed; and said upper die and said blank holder cooperate to fix a workpiece in said press when said slide actuates.

35. A press according to claim 8, wherein:

said pressing means includes an upper die coupled to said slide and a blank holder coupled to said at least one bolster cylinder; and said slide and said at least one bolster cylinder are controlled to permit said upper die and said blank holder to cooperate and tightly clamp a workpiece.

36. A press according to claim 35, wherein said cushion pressure arithmetic unit controls said at least one switching valve to reduce shock when said upper die and said blank holder cooperate.

37. A press according to claim 35, wherein:

said at least one bolster cylinder includes a first and at least a second bolster cylinder;

said at least one servo valve includes a first and at least a second servo valve;

said at least one switching valve includes a first and at least a second switching valve;

said first and at least second bolster cylinders are connected to said first and at least second servo valves, respectively;

said first and at least second switching valves are connected to said cushion pressure arithmetic unit and are also connected to said first and at least second servo valves, respectively; and said cushion pressure arithmetic unit controls actuation of said first and at least second switching valves to provide uniform support for said blank holder and to augment a clamping force on said workpiece.

38. A press according to claim 12, further comprising:

a blank holder coupled to said at least one bolster cylinder and adjacent said punch;

an upper die coupled to said slide and adjacent said counterpunch; and said slide and said at least one bolster cylinder are controlled to permit said upper die and said blank holder to cooperate and tightly clamp a workpiece.

39. A press according to claim 14, further comprising:

a blank holder coupled to said at least one bolster cylinder and adjacent said punch;

an upper die coupled to said slide and adjacent said counterpunch; and said slide and said at least one bolster cylinder are controlled to permit said upper die and said blank holder to cooperate and tightly clamp a workpiece.

40. A press according to claim 4, wherein:

said at least one main cylinder device includes a first main cylinder device and at least a second main cylinder device;

said first and at least second main cylinder devices spaced apart; and said slide arithmetic unit controls actuation of said first and at least second main cylinder devices effective to control a position and a speed of said slide.

41. A press according to claim 40, wherein said slide arithmetic unit controls actuation of said first and at least second main cylinder devices effective to control a horizontal alignment of said slide.

42. A press according to claim 3, wherein:

said at least one slide cylinder includes a first slide cylinder and at least a second slide cylinder;

said first and at least second slide cylinders spaced apart; and said slide pad arithmetic unit controls actuation of said first and at least second slide cylinders effective to control a position and a-speed of said slide pad.

43. A press according to claim 42, wherein said slide pad arithmetic unit controls actuation of said first and at least second slide cylinders effective to control a horizontal alignment of said slide pad.

* * * * *